US006612895B2

(12) United States Patent
Sze

(10) Patent No.: US 6,612,895 B2
(45) Date of Patent: Sep. 2, 2003

(54) GYROSCOPIC TOY

(75) Inventor: Chau King Sze, 2/F, 101 Fuk Wing Street, Shamsuipo, Kowloon (HK)

(73) Assignee: Chau King Sze, Hong Kong (HK)

( * ) Notice: Subject to any disclaimer, the term of this patent is extended or adjusted under 35 U.S.C. 154(b) by 0 days.

(21) Appl. No.: 10/337,157

(22) Filed: Jan. 6, 2003

(65) Prior Publication Data

US 2003/0129920 A1 Jul. 10, 2003

Related U.S. Application Data

(60) Provisional application No. 60/346,569, filed on Jan. 7, 2002.

(51) Int. Cl.[7] ..... A63H 1/00
(52) U.S. Cl. ..... 446/233; 446/234
(58) Field of Search ..... 446/233, 234, 446/235, 256, 259, 261, 264; 273/147

(56) References Cited

U.S. PATENT DOCUMENTS 2,039,819 A * 5/1936 Marx
2,078,729 A * 4/1937 Lemoine
2,762,162 A * 9/1956 Doljan

* cited by examiner

*Primary Examiner*—Derris H. Banks
*Assistant Examiner*—Jamila Williams
(74) *Attorney, Agent, or Firm*—Ware, Fressola, Van Der Sluys & Adolphson LLP

(57) ABSTRACT

A gyroscopic toy having a housing and an end post. The housing contains a spinning member, which can be caused to rotate about a first rotation axis of the housing for producing a gyroscopic effect while the end post rests on a surface to support the housing. A gimbals member is movably mounted on the exterior of the housing so that the first gimbals member can rotate about a second axis perpendicular to the first rotation axis. Two crescent-shaped members are movably mounted to the gimbals and one or two figurines are attached to the crescent-shaped members to enhance the visual effect. The toy comes with a support stand, the upper end of which has a concave surface to seat the end post. Alternatively, at least one foot of the figurine has a concave surface to seat the end post when the figurine is used as the support stand.

10 Claims, 5 Drawing Sheets

GYROSCOPIC TOY

This application is based on and claims the benefit of U.S. Provisional Application No. 60/346,569, filed Jan. 7, 2002.

FIELD OF INVENTION

The present invention relates generally to toys and, more particularly to a toy, a part of which can be manually made mobile.

BACKGROUND OF INVENTION

Spinning tops and gyroscopes are known to have a balancing property in that when the top or gyroscope is spun, the torque produced by the spinning can prevent the top or gyroscope from falling off its spinning or rotation axis. While the top or gyroscope is spinning, its rotation axis is moving around in a phenomenon known as "gyroscopic precession". Thus, gyroscopes have been widely used in nautical and flight navigation.

It is advantageous and desirable to incorporate the gyroscopic principle in toys to enhance the visual effect of such toys.

SUMMARY OF THE INVENTION

The present invention uses a flywheel rotatably mounted in a housing of a toy body and a tool to cause the flywheel to spin relative to the housing. The housing has a ball-end rested on a concave tip of a support. The torque produced by the fast spinning flywheel prevents the housing from falling off the support according to the gyroscopic principle.

Thus, the present invention provides a gyroscopic toy, which comprises:

- a housing with a rotational axis, wherein the housing includes:
  - a spinning member rotatably mounted in the housing,
  - a spur gear connected to the spinning member so as to cause the spinning member to rotate about the rotational axis relative to the housing for producing a gyroscopic effect, and
  - a mounting mechanism located on an exterior section of the housing, defining a mounting axis substantially perpendicular to the rotational axis;
  - a gimbals member movably mounted on the mounting mechanism for moving about the mounting axis relative to the housing; and
  - an end post connected to the housing for supporting the housing when the spinning member is rotating about the rotation axis for producing the gyroscopic effect.

Preferably, the toy has one or two figurines attached to the gimbals member for producing an enhanced visual effect of the toy.

Preferably, the gimbals member is a closed-loop having a circumference, and the gimbals member includes a pair of mounting members located on the circumference so as to allow one or more further gimbals member to be movably mounted on the mounting member, and the figurines to be attached to the further gimbals members.

Preferably, the spinning member comprises a rotor hub on which the spur gear is located, and a flywheel mechanically engaged to the rotor hub.

Preferably, the end post has a first round end and an opposing second end connected to the housing.

Preferably, the toy further includes a support stand having a first end for resting on a surface and an opposing second end, wherein the second end has a concave surface for seating the first end of the end post.

Alternatively, at least one of the feet of one figurine has a concave surface for seating the first end of the end post.

The present invention will become transparent upon reading the description taken in conjunction with FIGS. 1 to 8.

DETAILED DESCRIPTION OF THE INVENTION

Figure 1:
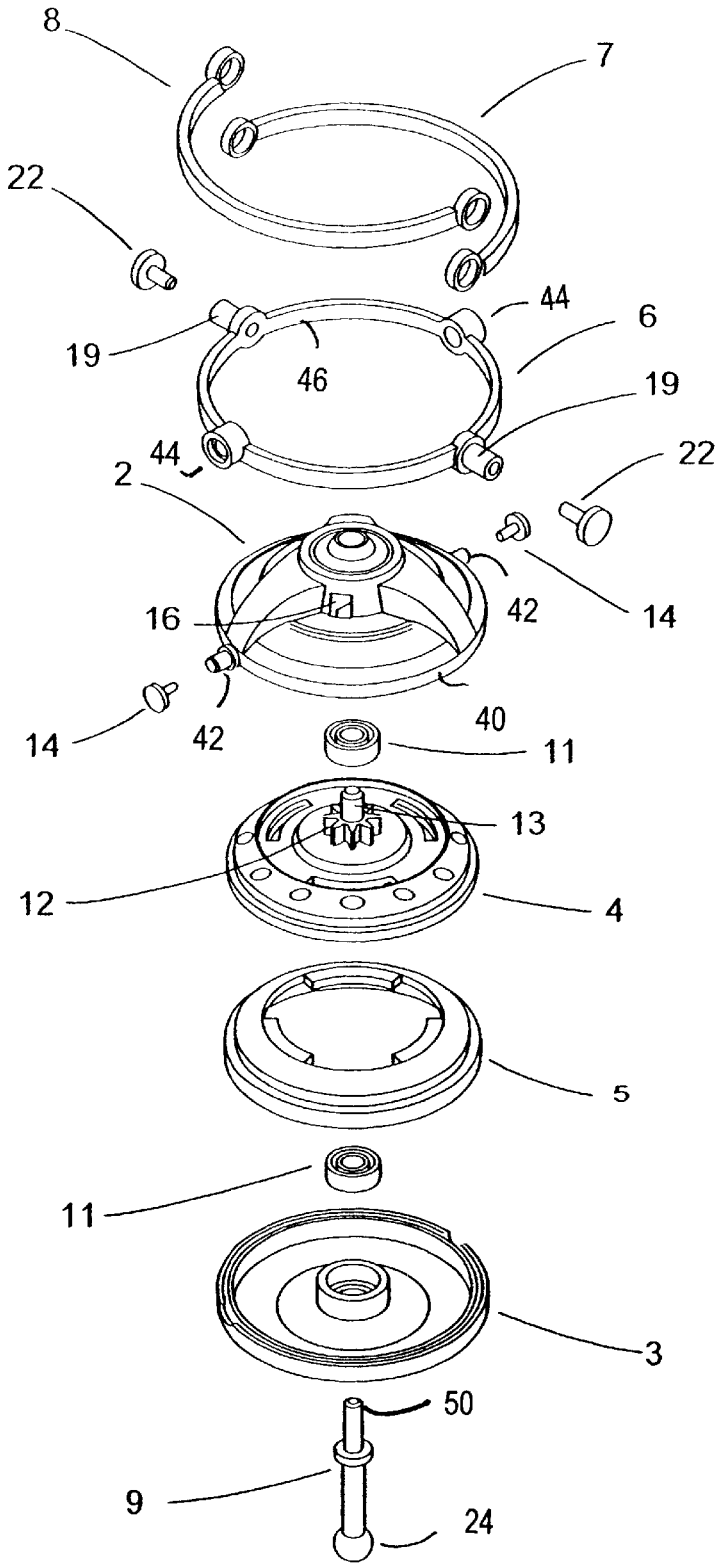
FIG. 1 shows a partially exploded view the gyroscopic toy body, according to the present invention.
Figure 2:
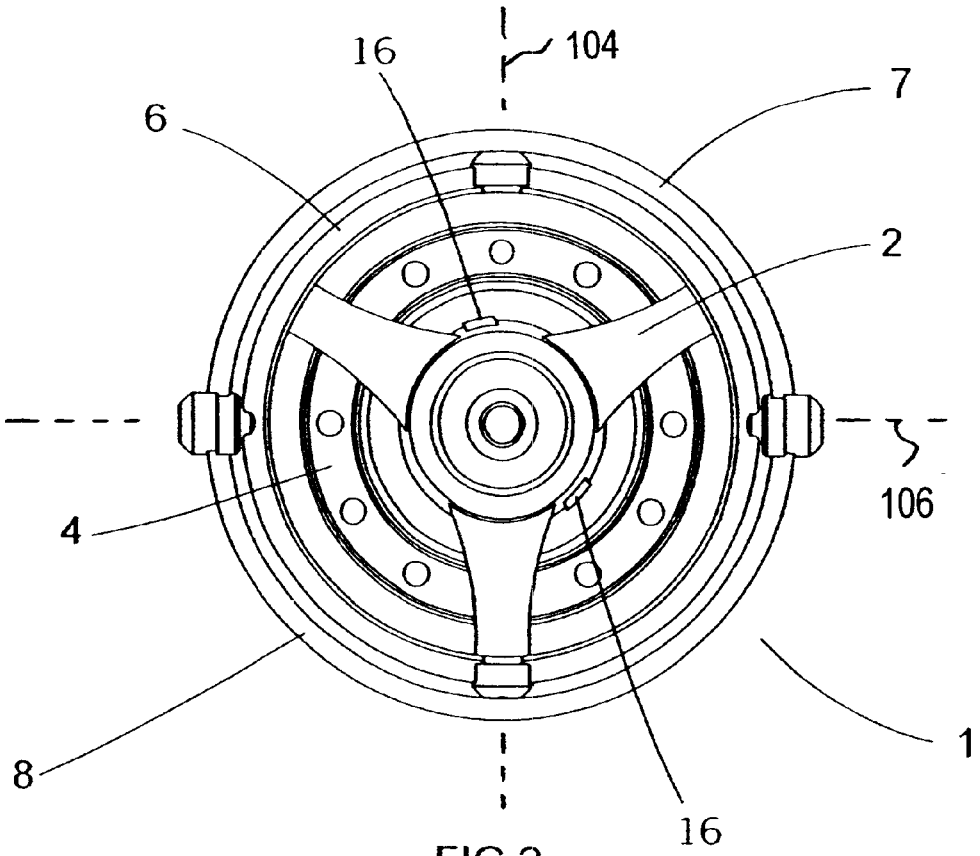
FIG. 2 shows a top view of the gyroscopic toy body.
Figure 3:
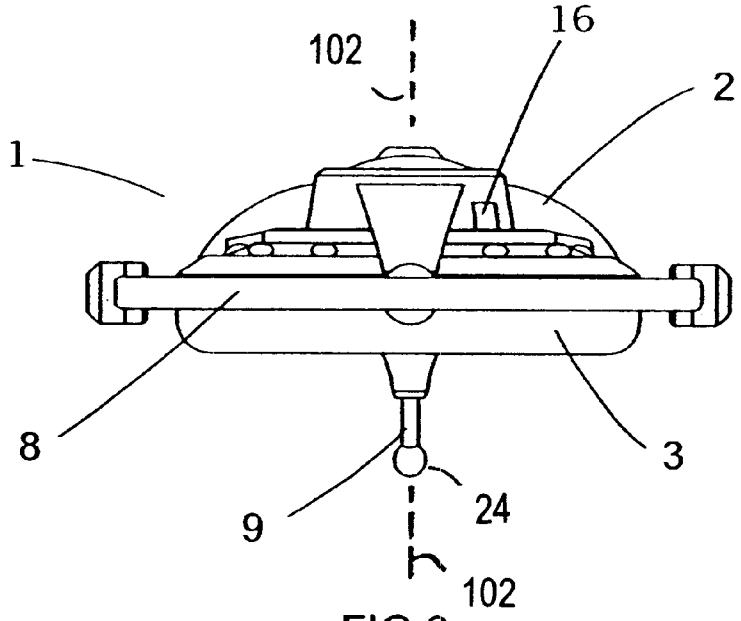
FIG. 3 shows a side view of the gyroscopic toy body.
Figure 4:
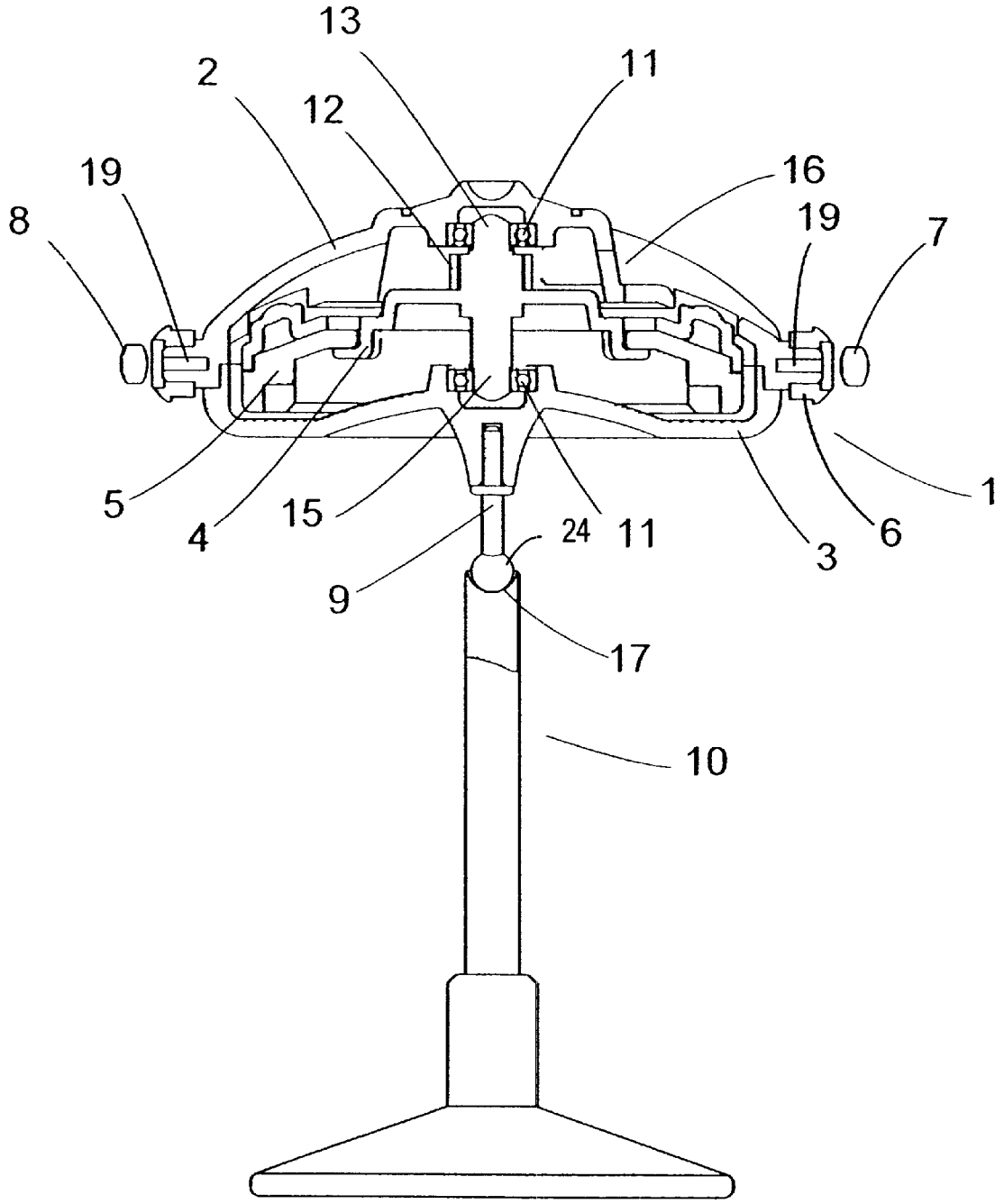
FIG. 4 shows a sectional view of the gyroscopic toy resting on a support.
Figure 5:
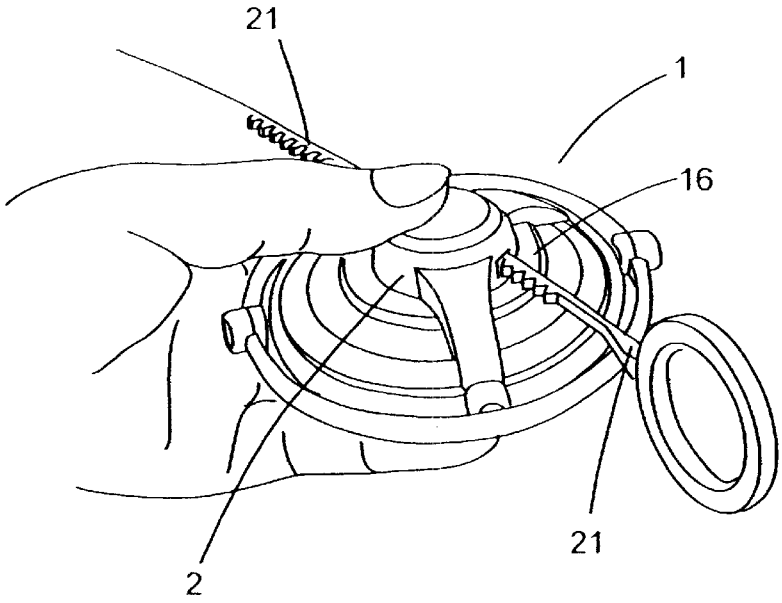
FIG. 5 illustrates how a toothed ripcord is used to activate the gyroscope.

The gyroscope toy, according to the preferred embodiment of the present invention, comprises a basic body 1 which includes a housing 30 formed by two complimentary half shells 2, 3. As shown in FIGS. 1–4, the half shells 2 and 3 have matching circumferences to be engaged to form the housing 30. A flywheel 5, preferably made of die-cast metal alloy, is mounted to a rotor hub 4. The rotor hub 4 comes with an integrated spur gear 12, and two shafts 13, 15 protruding from both sides of the rotor hub 4. The shafts 13, 15 are fitted to two ball bearings 11, preferably made of steel, and are further seated in the shells 2, 3. With the aid of the ball bearings 11, the flywheel 5, along with the rotor hub 4, can rotate freely about a first rotation axis 102 as defined by the shafts 13, 15, relative to the housing 30. Thus, the flywheel 5 and the rotor hub 4 form a spinning member for producing the gyroscopic effect when the spinning member is rotating relative to the housing 30. The upper half shell 2 has two diametrically opposite extending members 42 located on its circumference 40. The extending members 42 define a second rotation axis 104, substantially perpendicular to the first rotation axis 102. Inner gimbals 6, which comprise a-ring 46 with two circular openings 44 on the ring diameter, are mounted to the extending members 42 of the upper half shell 2 by two studs 14, preferably made of brass, so that the inner gimbals 6 can be rotated about the second rotation axis 104 relative to the housing 30. The inner gimbals 6 also have two bosses 19 extending from the ring 46 for mating with two crescent shape members 7, 8 which make the outer gimbals. The bosses 19 define a third rotation axis 106, preferably perpendicular to the second rotation axis 104, when the inner gimbals 6 are mounted on the body 1. The crescent-shaped members 7 and 8 are engaged with the inner gimbals 6 at the bosses 19 by another two studs 22. The crescent-shaped members 7, 8 are securely retained in place, yet they are free to rotate about the third rotation axis 106 whenever a force is applied thereto. A ball end post 9 has a first end 50, which is pressed fit to the bottom shell 3 of the body 1, and a ball-shaped second end 24. The ball end post 9 forms a longitudinal axis extending from the first rotation axis 102 defined by the shafts 13, 15. The longitudinal axis is the major axis about which the gyroscopic toy spins. The gyroscopic toy, according to the present invention, can be spun like a spinning top, except that the spinning action is caused by the fast rotating motion of the flywheel 5, relative to the housing formed by the two half shells 2, 3. The gyroscopic,toy, according to the present invention, can be "spun" on a smooth surface such that the ball-end post 9 is supporting the toy body 1 while the ballshaped shaped second end 24 touches the surface, preventing the toy body from touching the surface. Alternatively, the gyroscopic toy can be "spun" while the ball-shaped second end 24 is resting on a bowl-shaped recess or a dimple-like recess of a surface, so as to allow the gyroscopic toy to undergo a precession about the recess. Thus, in accordance with a preferred embodiment of the present invention, a support 10 is provided. The support 10 has a concave, dimpled tip 17 on which the ball-shaped second end 24 of the ball-end post 9 rests when the gyroscope spins up, as shown in FIG. 4.

As mentioned earlier, the "spinning" of the gyroscopic toy of the present invention is in fact the fast rotating motion of the flywheel 5 relative to the housing 30. To facilitate the fast rotating motion of the flywheel 5 along with the rotor hub 4, a flexible toothed ripcord 21 is provided. The ripcord 21 is designed to mesh with the spur gear 12 through the openings 16 on the top half shell 2. After the ripcord 21 is fully inserted through the openings 16, it can be pulled backward in a rapid motion in order to spin up the rotor hub 4 on which the flywheel 5 is mounted.

Figure 6:
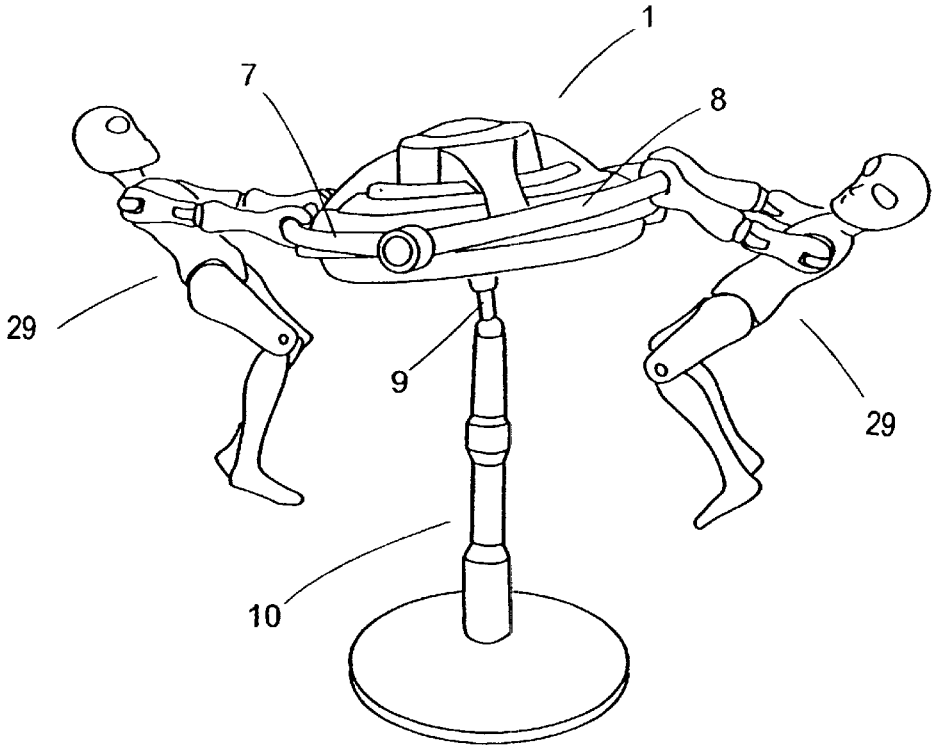
FIG. 6 illustrates the gyroscopic toy in action with two figurines being attached to the gimbals on the gyroscopic toy body.
Figure 7:
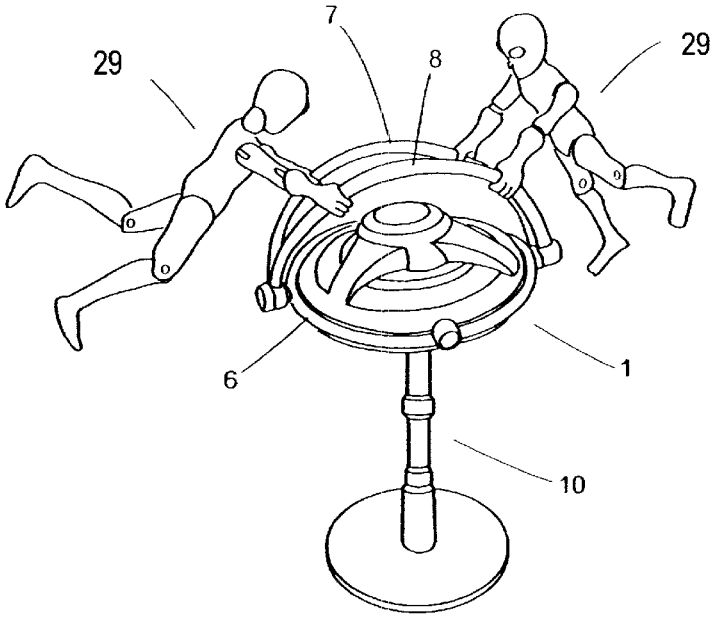
FIG. 7 illustrates the gyroscope in action with the outer gimbals adjusted at a different position.

Reference is now made to FIGS. 6–7, which illustrate the gyroscopic toy in action. Single or multiple figurines 29, which are built with fully adjustable joints, can be added to the gyroscopic toy body 1 The hands of the figurines 29 are designed to grip the crescentshaped members 7, 8 firmly so as to hold the figurines 29 in place. By maneuvering the gimbals 6 and the crescent-shaped members 7, 8 in different positions and posing the figurines 29, one can create different acrobatic setups of the figurines 29.

Figure 8:
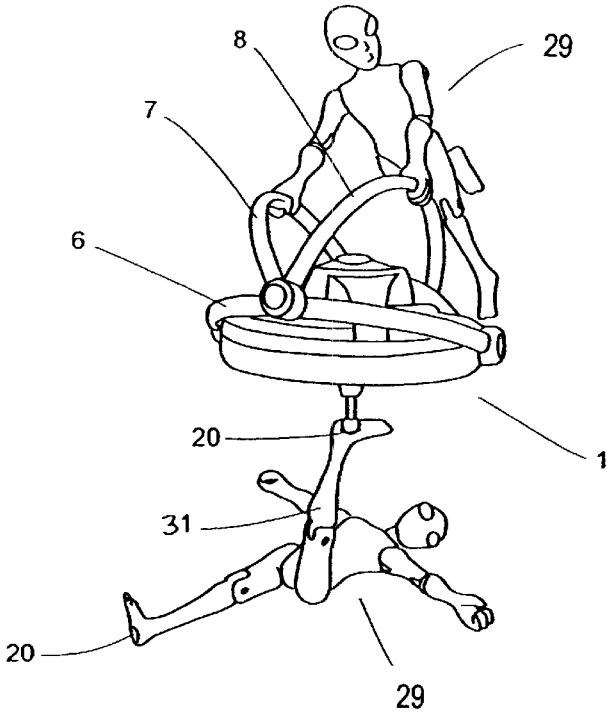
FIG. 8 shows a figurine with a dimpled foot used as a support for the gyroscopic toy body.

FIG. 8 shows a different setup, where the ball-end post 9 of the gyroscopic toy rests on a foot 31 of one figurine 29. A dimple-shape recess 20 similar to the tip 17 of the support 10 is provided on the bottom side of one or both feet of the figurine 29. By flipping up the foot 31 and posing the body as illustrated, the figurine 29 can be used to replace the support 10 in order to give an enhanced visual effect.

The present invention describes the use of figurines taking a human form. However, it is understood that other forms, including animal or other animated objects, may be used. Also, the support 10 can take a shape other than a post, as shown in FIG. 4, or a figurine 29, as shown in FIG. 8.

Thus, although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. A gyroscopic toy comprising:

a housing with a rotational axis, wherein the housing includes:

a spinning member rotatably mounted in the housing, a spur gear connected to the spinning member so as to cause the spinning member to rotate about the rotational axis relative to the housing for producing a gyroscopic effect, and a mounting mechanism located on an exterior section of the housing, defining a mounting axis substantially perpendicular to the rotational axis;

a gimbals member movably mounted on the mounting mechanism for moving about the mounting axis relative to the housing; and an end post connected to the housing for supporting the housing when the spinning member is rotating about the rotation axis for producing the gyroscopic effect.

2. The gyroscopic toy of claim 1 further comprising at least one figurine attached to the gimbals member for producing an enhanced visual effect of the toy.

3. The gyroscopic toy of the claim 1, wherein the gimbals member includes a ring having a circumference, and a pair of mounting members located on the circumference, said gyroscopic toy further comprising at least one further gimbals member having two ends for movably mounting on the mounting mechanism, and a figurine attached to said at least one further gimbals member.

4. The gyroscopic toy of claim 1, wherein the gimbals member includes a ring having a circumference, and a pair of mounting members located on the circumference, said gyroscopic toy further comprising two open-loop members each having two ends for movably mounting on the mounting member, and at least one figurine attached to one of the open-loop members.

5. The gyroscopic toy of claim 1, wherein the spinning member comprises a rotor hub on which the spur gear is located, and a flywheel mechanically engaged to the rotor hub.

6. The gyroscopic toy of claim 5, wherein the housing comprises at least one ball bearing for mounting the rotor hub to the housing for rotation.

7. The gyroscopic toy of claim 1, wherein the housing comprises a first half shell and a second half shell mechanically engaged with the first half shell.

8. The gyroscopic toy of claim 1, wherein the end post has a first round end and an opposing second end connected to the housing.

9. The gyroscopic toy of claim 7 further comprising a support having a first end for resting on a surface and an opposing second end, wherein the second end has a concave surface for seating the first end of the end post.

10. The gyroscopic toy of claim 7 further comprising a figurine having two lower limbs, at least one of the lower limbs has a concave surface for seating the first end of the end post.

* * * * *

UNITED STATES PATENT AND TRADEMARK OFFICE

CERTIFICATE OF CORRECTION

PATENT NO. : 6,612,895 B2 
DATED : September 2, 2003
INVENTOR(S) : Chau King Size It is certified that error appears in the above-identified patent and that said Letters Patent is hereby corrected as shown below:

Column 3,
Line 7, after "gyroscopic,toy" should be -- gyroscopic toy --.
Line 38, after "body 1" -- . -- should be inserted.

Signed and Sealed this

Sixteenth Day of December, 2003

JAMES E. ROGAN
*Director of the United States Patent and Trademark Office*